US006736030B2

(12) United States Patent
McLuen

(10) Patent No.: US 6,736,030 B2
(45) Date of Patent: May 18, 2004

(54) CHAMPAGNE CORK REMOVER

(76) Inventor: Carl T. McLuen, 455 Woodcock Rd., Sequim, WA (US) 98382

( * ) Notice: Subject to any disclaimer, the term of this patent is extended or adjusted under 35 U.S.C. 154(b) by 141 days.

(21) Appl. No.: 10/271,381

(22) Filed: Oct. 16, 2002

(65) Prior Publication Data

US 2004/0074341 A1 Apr. 22, 2004

(51) Int. Cl.[7] ..... B67B 7/06
(52) U.S. Cl. ..... 81/3.44; 81/3.37; 81/3.29
(58) Field of Search ..... 81/3.44, 3.36, 81/3.37, 3.29, 3.39, 3.4, 3.42, 3.55, 3.56

(56) References Cited

U.S. PATENT DOCUMENTS

| | | | | |
|---|---|---|---|---|
| 4,481,228 | A | 11/1984 | Morel | |
| 4,519,277 | A | 5/1985 | Raab | |
| 4,520,696 | A | 6/1985 | Wolze | |
| 4,590,821 | A | 5/1986 | Olson | |
| 4,598,613 | A | 7/1986 | Baum | |
| 4,680,993 | A | 7/1987 | Feliz | |
| 4,708,033 | A | 11/1987 | Eash | |
| 4,729,267 | A | 3/1988 | Giebeler | |
| 4,750,391 | A | 6/1988 | Sweath | |
| 4,852,432 | A | 8/1989 | Rodriques | |
| 4,875,394 | A | 10/1989 | Crudgington | |
| 4,947,711 | A | 8/1990 | Giebeler | |
| 5,000,063 | A | 3/1991 | Federighi | |
| 5,016,499 | A | 5/1991 | Saveland | |
| 5,040,437 | A | 8/1991 | Mueller | |
| 5,862,720 | A | 1/1999 | McNellis | |
| 6,062,107 | A | 5/2000 | Johnson | |
| 2002/0046630 | A1 * | 4/2002 | Olivera et al. | 81/3.29 |

OTHER PUBLICATIONS

Champagne Opener™, Item #2257 Franmara Inc. Salinas, California, Jul. 23, 2002.

* cited by examiner

*Primary Examiner*—D. S. Meislin

(57) ABSTRACT

A hand tool with a U-shaped cutout to slide into the groove at the top of a champagne bottle, and pivoted lever-arms above the cutout straddling the stopper of the bottle. Extractor links connected to these lever-arms, are hinged at the outer end, and have teeth across the inner end, which is aligned with the stopper. Squeezing the lever-arms together causes the extractor links to engage and compress that part of the stopper exposed above the top of the bottle. The extractor links are angled upward toward the toothed end, so that the resulting combined upward force of the two links on opposite sides of the stopper, cause it to be extruded upward. Repeated actuations may be used to remove the stopper completely. The tool grips, and retains the stopper when completely closed.

11 Claims, 3 Drawing Sheets

CHAMPAGNE CORK REMOVER

BACKGROUND

1. Field of the Invention

This invention relates to opening champagne bottles, and the like, by applying a force to the exposed part of the cork, or plastic, stopper.

2. Prior Art

A number of devices have been patented to accomplish this task, most of which attempt to pry or pull the stopper out by exerting a force between the top of the bottle and the enlarged part of the cork, which is exposed. Simple lever systems such as those found in U.S. Pat. No. 4,598,613 Jul. 8, 1986 to Frederick W. Baum, U.S. Pat. No. 4,590,821 May 27, 1986 to James C. Olson, and U.S. Pat. No. 4,680,993 Jul. 21, 1987 to Jack M. Feliz, are examples of such devices. Geared lever systems are also used in some designs, such as found in U.S. Pat. No. 4,750,391 Jun. 14, 1988 to Stanley L. Sweath, and U.S. Pat. No. 4,947,711 Aug. 4, 1990 to Ben F. Glebeler. A cranked threaded shaft mated with a threaded tubular column are used to exert the force in U.S. Pat. No. 5,040,437 Aug. 20, 1991 to John H. Mueller.

In all of these, the problem is not the force required to dislodge the cork stopper, but rather it is in the means of applying it to the soft and frangible part of the cork which is exposed. In some prior art such as is found in U.S. Pat. No. 4,875,398 Oct. 24, 1989 to Cleveland B. Crudington, the stopper must be partially raised to enable the tool to be inserted under it. Some require that a thin tool be forced between the top of the bottle and the bulge of the cork, and others rely on sharpened tongs as is noted on U.S. Pat. No. 5,000,063 Mar. 19, 1991 to George Federighi, and U.S. Pat. No. 4,708,033 Nov. 24, 1987 to Lester E. Eash. One champagne opener found on the market is available from Franmara, Inc. of Salinas, Calif. This heavy tool has a large tooth on each of two hinged handles. The instructions are to drive these into the cork, and to twist the cork thus gripped, in opposite direction to the bottle, until internal pressure pushes the cork out.

Champagne corks are the tightest before the initial displacement, which breaks the bond to the bottle created over weeks or months of storage. Teeth forced into the uncompressed cork can tear or fracture the cap, leaving even less to work with. Most champagne is opened at the table in restaurants or private homes, and large complicated machines, such as that of John Mueller noted above, are unsuitable for such use.

Most of these prior art devices fail to achieve their objective due to the problem of effectively connecting to the cork stopper without damaging it. Tools that try to twist it loose can easily shear the cap off so that only a cork screw can be used to try to save it. It is necessary to grip the cork firmly over an area of that portion exposed, and to compress and lift it slowly and steadily out of the bottle. The Cork Remover described herein, does just that.

SUMMARY

The present invention is comprised of a simple pliers type tool which can grip a champagne stopper firmly on opposite sides, and force it upward without fracturing the cork, or requiring much strength or effort. This tool can retain the stopper as it is removed.

Objects and Advantages

Accordingly, the objects and advantages of my invention are:

a) to provide a champagne cork remover which can grip and raise a champagne cork with little strength or effort required.

b) to enable one hand operation of said cork remover so that the other hand is free to support the bottle, or to assure that pressure does not force out the stopper prematurely c) to provide a tool which can retain the cork or other stopper as it exits the bottle.

d) to provide a simple, uncomplicated design which can be produced and sold at low cost.

e) To provide a device which can also remove plastic bottle stoppers used for sparkling cider, and similar beverages, sold in champagne size bottles.

f) to enable wine stewards to quickly serve champagne formally, and with ease and grace, in restaurants and dining rooms.

g) to provide a tool which requires no maintenance or adjustment, and is constructed of corrosion-free materials.

REFERENCE NUMERALS IN DRAWINGS

Figure 1:
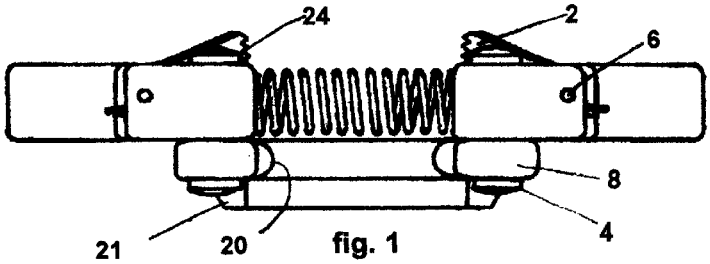
FIG. 1 is an end view of the cork remover.
Figure 2:
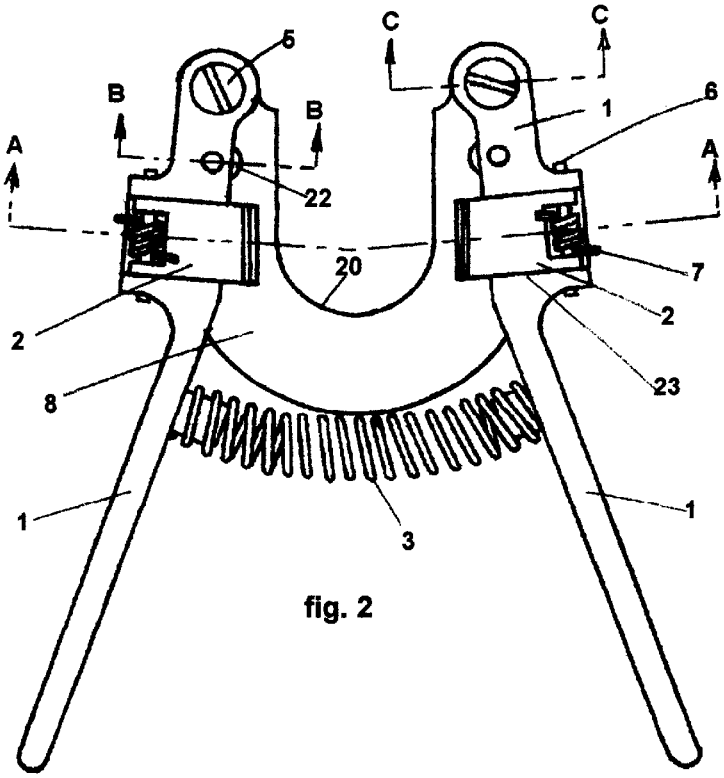
FIG. 2 is a side view of the cork remover.
Figure 3:
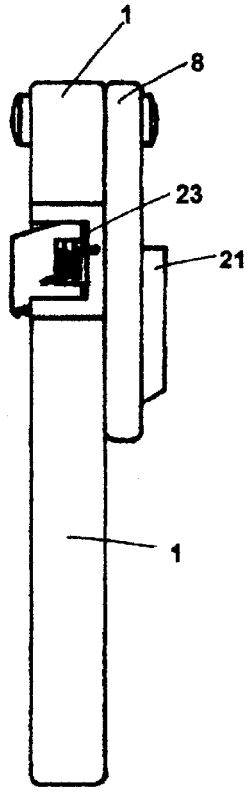
FIG. 3 is a plan view of the champagne cork remover, showing the plier-like lever-arms, and the attachment to the base plate.
Figure 4A:
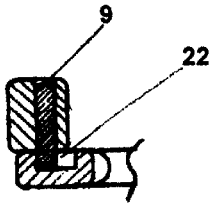
FIG. 4*a* is a section view through B—B, showing a stop pin and its pocket, which limits the angular motion of each lever-arm.
Figure 4B:
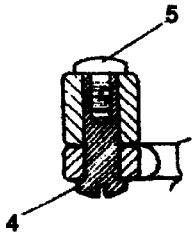
FIG. 4*b* is a section view through C—C, showing a lever-arm pivot and its' retaining screw, which connects each lever-arm to the base plate.

| | |
|---|---|
| 1: lever-arms (left/right-mirror-image) | 20. U-shaped cutout |
| 2: Extractor links (left/right-symmetrical) | 21: Centering flange |
| 3: Compression spring | 22: Stop-pin cavity |
| 4: Pivot | 23: Extractor channels |
| 5: Fillister head screw | 24: Extractor link teeth |
| 6: Axle-pin | |
| 7: Torsion spring | |
| 8: Base plate | |
| 9: Stop-pin | |

Parts (alternate configuration):
30: Alternate base plate
31: Alternate lever-arm, right
32: Alternate lever-arm, left DESCRIPTION: FIGS. 1 THROUGH 5*c*
PREFERRED EMBODIMENT The preferred embodiment of this invention is illustrated in the three views of FIG. 1, FIG. 2, and FIG. 3. The lever-arms 1, shown in all three views, are connected to the base plate 8, by two pivots 4 These are kept in place by fillister head screws 5. The pivots 4, are a close but loose fit into the lever-arms 1, and of a length that allows free angular movement of the lever-arms. A compression spring 3, fitted between the lever-arms 1, tends to hold them apart. Stop-pins 9, protruding through the lever-arms into the stop- pin cavities 22 serve to constrain angular movement of the lever-arms to within the comfortable manipulation range of the average adult hand. Extractor links 2, are located in channels 23, formed across the lever-arms at a point in line with the center of the radius of the U-shaped cutout 20. Thus located, the extractor links 2, are moved toward the center of the U-shaped cutout 20, when lever-arms 1, are moved together.

The U-shaped cutout 20, of the base plate is configured to fit into the annulus below the top of a champagne bottle. The extractor links 2, pivot on a small axle-pin 6, fitted into holes across the channel 23, in each lever-arm. A torsion spring 7, around this axle-pin serves to hold each extractor link 2, into position down against the floor of the extractor channel. In this position, the extractor links 2, best seen in FIG. 5*a*, contact a champagne cork, (shown in phantom) at a point higher than the axle-pin 6, described above. The edge of the extractor link 2, at the point of contact with such stopper is formed of a series of V-shaped teeth 24, or striations, which extend across the face of the extractor link 2. Tips of these teeth form a radius downward and away from the point of contact. As the lever-arms 1, are moved towards each other, (closed), the extractor links are forced against the cork of the stopper, so that a firm, uniform grip over an area on opposite sides of the cork is established. Due to the upward angle of the extractor links, a complementary force is created upward on the free end of the extractor link, and thence the cork, which are moved upward together. Lever ratios are such that a large mechanical advantage is created, and the stopper breaks free and moves up a distance quite easily. Relaxation of hand grip on the lever-arms allows the compression spring 3, to open the lever-arms 1, and the extractor links 2, to be reseated by the torsion springs to the floor of the extractor channels 23, in place for further operation.

ALTERNATE EMBODIMENT: FIG. 6

Figure 6:
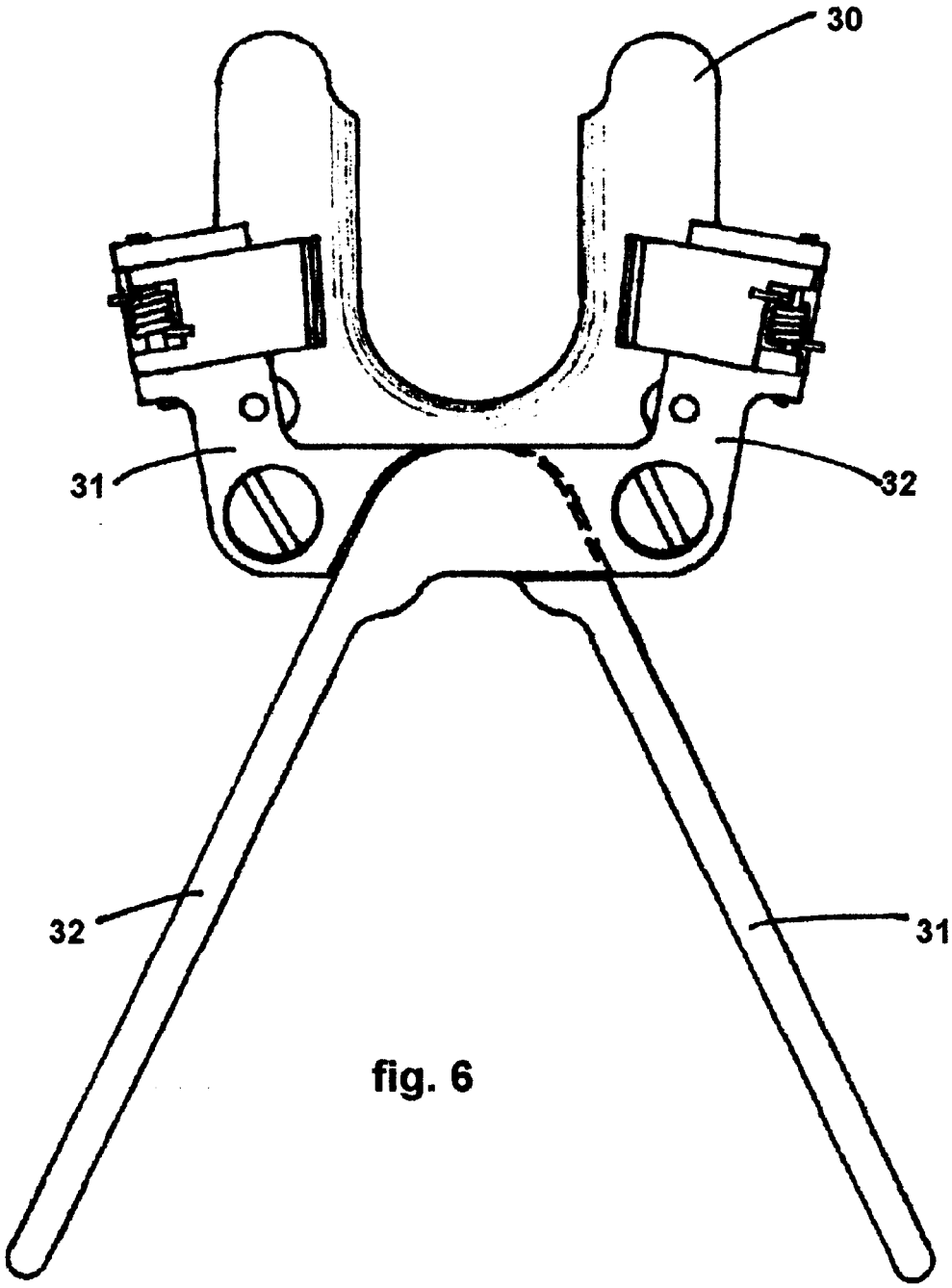
FIG. 6 is a plan view of an alternate configuration of the cork remover wherein the lever-arms, of zig-zag shape, are pivoted on the rear of the base plate, behind the U-shaped cutout, and then cross each other, and bend back again to handles at a second end. Extractor links are located across the end of an extension of the lever-arms forward from the pivot toward the front of the base plate, and straddle the stopper of a champagne bottle ensconced therein.

The alternate embodiment shown in FIG. 6 has pivot points at the opposite end of the base plate behind the U-shaped cutout. The alternate base plate 30, has pivot holes, and stop cavities relocated to accommodate this change. The zig-zag lever-arms (left 32 and right 31) cross over each other, and then bend back to form handles at a second end. The actuator links are located on an extension forward along, and toward the open end of the U-shaped cutout, straddling the stopper of a bottle of champagne ensconced therein. Action to close these lever-arms results in motion of the extractor links toward the cork in the same way as in the preferred embodiment. These zig-zag lever-arms have cutouts in the area where they overlap, so that they are parallel as in stalled on the base plate. Other parts of the alternate embodiment listed below are identical to those of the preferred embodiment.

| | |
|---|---|
| 2: Extractor links | 3: Compression spring |
| 4: Pivot | |
| 6: Axle-pin | 7: Torsion spring |
| 9: Stop-pin | |
| 5: Fillister head screw | |

Figure 5A:
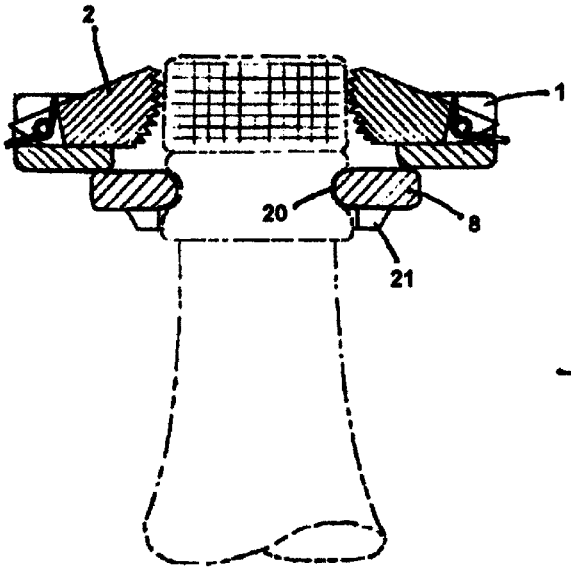
FIG. 5*a* is a section view through A—A, showing the position and shape of the extractor links, which compress and raise the champagne cork when the lever-arms are closed towards each other. A phantom view of a champagne bottle and its cork is shown as it would be positioned in the cork remover.
Figure 5B:
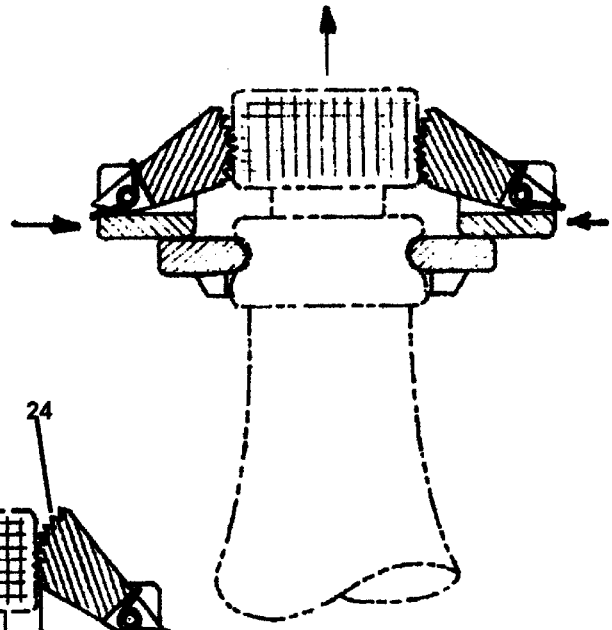
FIG. 5*b* is the same as 5*a* above, except that the lever-arms are partially closed so that the resulting motion of the extractor links to pinch and raise the cork are illustrated. The resulting annular space between the head of the cork and the top of the bottle is evident.
Figure 5C:
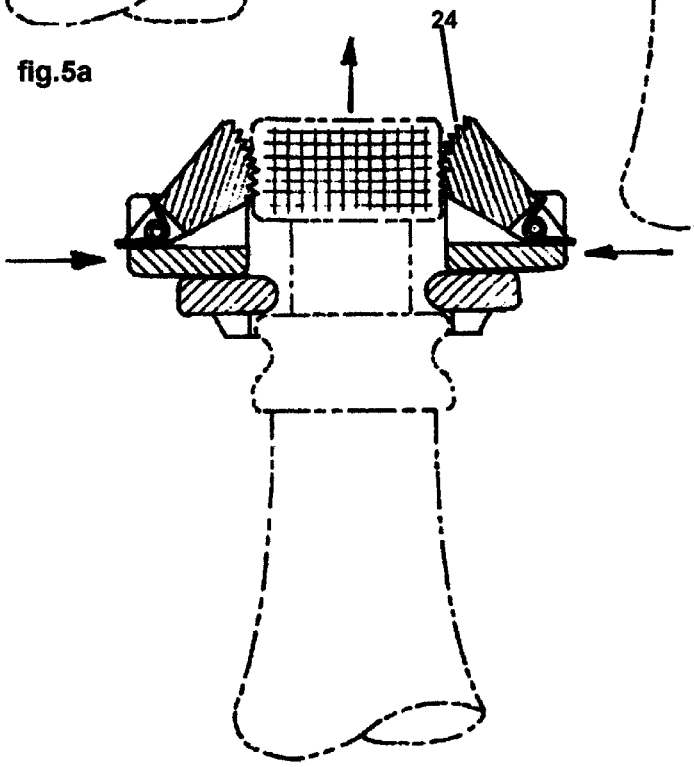
FIG. 5*c* shows the sectional view of 5*b* above with the cork remover repositioned atop the bottle, in the space created between the cork head and the bottle top, by the initial operation of the cork remover as shown in FIG. 5*b*. The lever-arms are re-closed as shown in this figure, and the extractor links have raised the cork farther upward.

OPERATION: FIGS. 5*a*, 5*b*, and 5*c*.

A number of operational sequences are possible with this tool, but the preferred one is as follows:

a) the wire basket and foil are removed from the bottle
b) the U-shaped cutout 20, of the Cork Remover base plate 8, is positioned in the top bottle annulus, as shown in FIG. 5*a*, and the lever-arms 1, are firmly closed. The resulting action of the extractor links 2, to grip, and raise the cork upward provides an annular space between the bottle top and the enlarged cap of the cork as shown in FIG. 5*b*.
c) the Cork Remover is re-positioned with the U-shaped cutout 20, of the base plate 8, fitted into this space created atop the bottle. The centering flange 21, serves to locate the Cork Remover on the bottle to center the stopper in line with the extractor links 2
d) in this position, the lever-arms 1, are again firmly closed, raising the cork stopper farther, and clamping the teeth 24, of the extractor links 2, firmly into the cork as shown in FIG. 5*c*.
e) at this point, the bottom of the cork will be above the tapered lower portion of the bottle neck, and any slight angular motion of the tool will enable internal pressure to pop the cork out. A firm grip on the lever-arms 1, retains the cork in the tool.

An alternate method suitable for use by wine stewards wherein the champagne is usually provided in an ice bucket is as follows:

a) the wire basket and foil are removed as in the preferred method of operation
b) the Cork Remover is fitted in the bottle top annulus and a napkin is held firmly over the stopper with the free hand
c) repeated closing, and opening, of the lever-arms 1, and the resulting action of the extractor links 2, on the cork, jacks the cork up and out of the bottle, into the napkin.

What is claimed is:

1. A hand tool, configured to engage with the top of a champagne bottle, and to grip that part of a cork stopper exposed above the top of said bottle and force said stopper out of the bottle, comprising:

(a) a base plate configured to engage with the top of a champagne bottle (b) a pair of elongated mirror-image lever-arms mounted pivotably on said base plate (c) a pair of mirror image extractor links mounted on said lever-arms (d) additional means of:

connecting said lever-arms to said base plate biasing said lever-arms to an open, or apart position limiting angular excursion of said lever-arms to predetermined open, and closed positions connecting each of said extractor links to each of said lever-arms biasing said extractor links toward a seated position against said lever-arms whereby, a hand tool is assembled which can be manipulated like a pair of ordinary pliers, to engage with the top of a champagne bottle, and to force out the stopper therein, quickly and easily, by simply opening and closing the lever-arms of said hand tool.

2. The hand tool according to claim 1, wherein said baseplate includes a central U-shaped cutout at a first end, configured to fit slidably into the concave annulus at the top of a champagne bottle, and pivot holes and stop-pin cavities disposed along each side of said U-shaped cutout, at predetermined distances from the first end of said baseplate.

3. The hand tool according to claim 1, wherein said mirror image lever-arms each have a pivot hole at a first end, a stop pin hole at a predetermined distance from said pivot hole, an extractor channel across each lever-arm at a predetermined distance from the pivot hole, and an angled extension to a second end to form a handle, the extractor chancel across each lever-arm being of predetermined width, with a flat bottom and axle-pin holes in line through both sides of said channel, at predetermined distances from the bottoms, and ends of said channel.

4. The hand tool according to claim 1, wherein the means of connecting the lever-arms to said baseplate, further includes pivots, and mating screws which connect together through pivot holes provided in said baseplate, and in each of said lever-arms, to retain connect said lever-arms pivotably to said base plate.

5. The hand tool according to claim 1, wherein the means of limiting the angular excursion of said levers further includes:

stop pins pressed through holes provided in said lever-arms, and extending into said stop pin cavities provided in said base plate whereby said the cavities, being of larger diameter than said stop pins, allow angular excursions of said lever-arms to that angle whereat said stop pins engage a side of one of said stop-pin, cavities thus limiting angular movement of said lever-arms to predetermined open, or closed positions.

6. The hand tool according to claim 1, wherein the men of biasing said lever-arm apart, is a spring such as a compression spring, connected between said lever-arms to urge said lever-arms toward the open, or apart position.

7. The hand tool according to claim 1, wherein said mirror image extractor links are of a predetermined thickness having an axle-pin hole at a first end adjacent to a flat bottom surface, and an arc of to across a second end, the center of said arc of teeth being at a predetermined distance above said flat surface, so that a center line between said pin hole, and the center of said arc of teeth, is at an upward angle, away from said flat surface.

8. The hand tool of claim 1, wherein the means of attaching said extractor links to said lever-arms includes an axle pin through the pinholes provided in said extractor links, and into holes provided in the sides of said extractor channel in each of said lever arms, so that said flat bottom surfaces of said extractor links rest on the bottoms of said extractor channels, and as thus installed, are biased to this seated position against said lever-arms by a spring, such as a torsion spring, disposed around said axle pin, to exert a torque against said extractor link toward the downward, or seated position.

9. The hand tool according to claim 1, wherein the assembled tool configuration is such that said extractor channels, and therefor said extractor links, are aligned with the center of, and on opposite sides of the stopper of a bottle of champagne engaged therein.

10. The hand tool according to claim 1, whereby manual closure of said elongated lever-arms forces said extractor links against the exposed top of the stopper of a bottle of champagne engaged therein, whereby the said forces transmitted to the extractor links are directed angularly upward through said extractor links from said axle-pin hole, at the first ends of said extractor links, to the point of contact with the cork stopper at the center of the arc of said teeth at the second ends of said extractor links, the resultant forces at the point of contact, being horizontal forces to grip the stopper, between said extractor links, and vertical forces, to extrude the stopper up, and out of the bottle.

11. The hand tool according to claim 1, wherein said mirror image lever-arms are of zig-zag shape and of predetermined thickness, each having:

An extractor channel of predetermined width and with a flat bottom, across a first end of said lever-arm, and with axle-pin holes in line across said extractor channel at a predetermined distances from the bottom, and ends of said extractor channel A pivot hole at predetermined distance from said first end along the lever-arm extension at an oblique angle, and at reduced thickness for a predetermined distance from said pivot hole further extension at a reversed oblique angle to form an elongated handle suitable for hand operation whereby, being of mirror image configuration, and of reduced thickness between said oblique angles, said zig-zag lever-arms can be installed on said baseplate to cross over other such as those of an ordinary pair of pliers, the hand tool being thus created is an alternate configuration.

* * * * *